US006845715B2

(12) United States Patent
Sansolo

(10) Patent No.: US 6,845,715 B2
(45) Date of Patent: Jan. 25, 2005

(54) EXPLOSION SIMULATOR

(76) Inventor: Arie Sansolo, 19 Harel Street, Afridar, Ashkelon, 78649 (IL)

( * ) Notice: Subject to any disclaimer, the term of this patent is extended or adjusted under 35 U.S.C. 154(b) by 0 days.

(21) Appl. No.: 10/370,467

(22) Filed: Feb. 24, 2003

(65) Prior Publication Data

US 2004/0200374 A1 Oct. 14, 2004

(51) Int. Cl.[7] ..... F42B 12/46

(52) U.S. Cl. ..... 102/367; 102/368; 102/355; 102/205; 102/369; 102/486; 102/335

(58) Field of Search ..... 102/367–368, 102/205, 486, 369, 498, 395, 355, 335, 487

(56) References Cited

U.S. PATENT DOCUMENTS 940,033 A * 11/1909 Larsen ..... 102/205
1,614,739 A * 1/1927 Lawrence ..... 102/367
1,659,158 A * 2/1928 Oglesby et al. ..... 102/368
2,455,336 A * 11/1948 Jones ..... 102/205
3,492,945 A * 2/1970 Filippi ..... 102/498
3,942,445 A * 3/1976 Baker et al. ..... 102/205
5,313,888 A * 5/1994 Martin ..... 102/205
H1352 H * 9/1994 Bundy et al. ..... 102/205
5,481,979 A * 1/1996 Walder ..... 102/355
5,824,945 A * 10/1998 Barlog et al. ..... 102/335
5,929,369 A * 7/1999 Bissig et al.

* cited by examiner

*Primary Examiner*—Michael J. Carone
*Assistant Examiner*—Lulit Semunegus
(74) *Attorney, Agent, or Firm*—David Klein; Dekel Patent Ltd.

(57) ABSTRACT

An explosion simulator including a chamber at least partially filled with a pyrotechnic material, the chamber being formed with a plurality of holes arranged for fluid products of an explosion of the pyrotechnic material to pass therethrough, and a delaying detonator adapted to detonate the pyrotechnic material, the detonator being adapted to delay onset of the explosion of the pyrotechnic material a period of time after actuation of the detonator.

11 Claims, 2 Drawing Sheets

EXPLOSION SIMULATOR

FIELD OF THE INVENTION

The present invention relates generally to explosive devices, and particularly to an explosion simulator.

BACKGROUND OF THE INVENTION

During the course of certain exercises and training regimes for anti-bomb squads, anti-terrorist squads, special weapons and tactics (SWAT) teams, and other police, law enforcement, military or commando units, different explosive charges may be detonated. Since it may be unsafe and undesirable to use real bombs in such exercises, explosion simulators have been used instead.

Explosion simulators may be used not just in military applications, but also in commercial applications, such as but not limited to, intrusion alarms, diversion devices (stun grenades), bird repelling noisemakers and stage effects. Typically in the prior art, for military applications, explosion simulators generate bang, smoke and flash cues in response to electrical signals from an electronic scoring system. During engagement training, the explosion simulators warn nearby units of an attack and indicate the strike locations of the artillery rounds to the attacking forces. An explosion simulator may provide bang, smoke and flash cues, which are detectable by personnel under a variety of conditions, such as high winds or dense foliage.

However, the explosion simulator must provide these cues while not representing a safety hazard to nearby personnel. Prior art pyrotechnic explosion simulators may pose dangers to personnel, such as accidental explosion in the hand of a person grasping such a simulator.

SUMMARY OF THE INVENTION

The present invention seeks to provide a safe explosion simulator that may provide several advantages over the prior art. The explosion simulator of the invention may have a delaying detonator that delays the onset of an explosive charge or flash. The delay may act as a safety feature by providing enough time to distance oneself from the simulator. The simulator may be easily thrown, similarly to a stick. The simulator may not cause damage to the hand of the user even if it accidentally explodes while being held in the hand.

There is thus provided in accordance with a preferred embodiment of the present invention an explosion simulator including a chamber at least partially filled with a pyrotechnic material, the chamber being formed with a plurality of holes arranged for fluid products of an explosion of the pyrotechnic material to pass therethrough, and a delaying detonator adapted to detonate the pyrotechnic material, the detonator being adapted to delay onset of the explosion of the pyrotechnic material a period of time after actuation of the detonator.

In accordance with a preferred embodiment of the present invention a handle extends from the chamber, which includes a hand-grip portion positioned separately from the pyrotechnic material.

Further in accordance with a preferred embodiment of the present invention the holes are formed along a longitudinal length of the chamber. There may be at least two (e.g., four) sets of holes spaced about a perimeter of the chamber. The sets of holes may be spaced generally equidistantly about the perimeter of the chamber.

Still further in accordance with a preferred embodiment of the present invention the detonator includes a friction cap adapted to ignite upon a sufficient rubbing action.

In accordance with a preferred embodiment of the present invention the friction cap is attached to a pull-string disposed through the handle.

Further in accordance with a preferred embodiment of the present invention a collar protrudes outwardly from at least one of the chamber and the handle.

In accordance with a preferred embodiment of the present invention the explosion simulator is stick-shaped and throwable.

In accordance with another preferred embodiment of the present invention the chamber is telescopically extensible from the handle.

Further in accordance with a preferred embodiment of the present invention the chamber includes anti-gripping elements extending therefrom adapted to interfere with manually gripping the chamber.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

Figure 2:
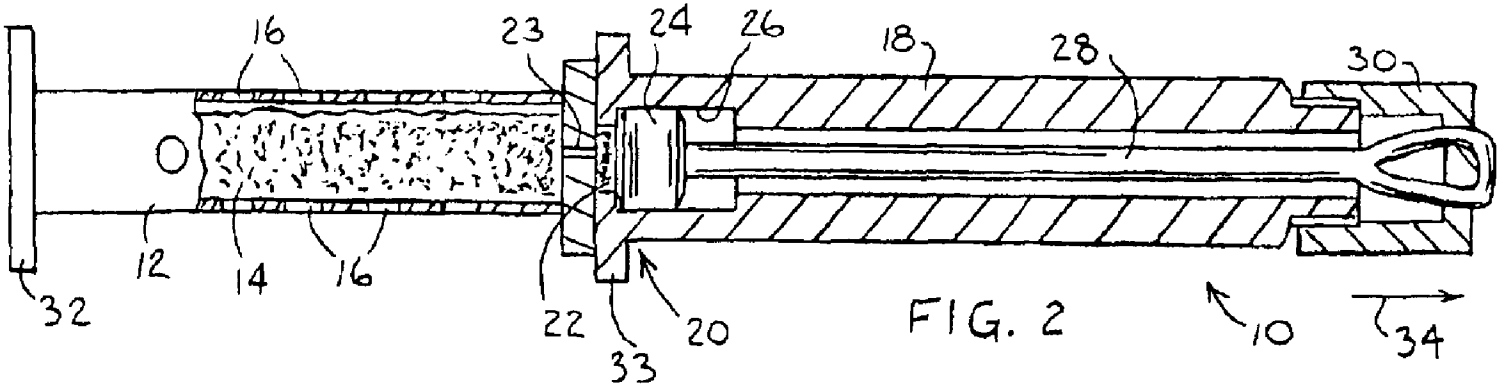
FIGS. 1 and 2 are simplified pictorial and sectional illustrations, respectively, of an explosion simulator, constructed and operative in accordance with a preferred embodiment of the present invention, FIG. 2 being taken along lines II—II in FIG. 1.
Figure 1:
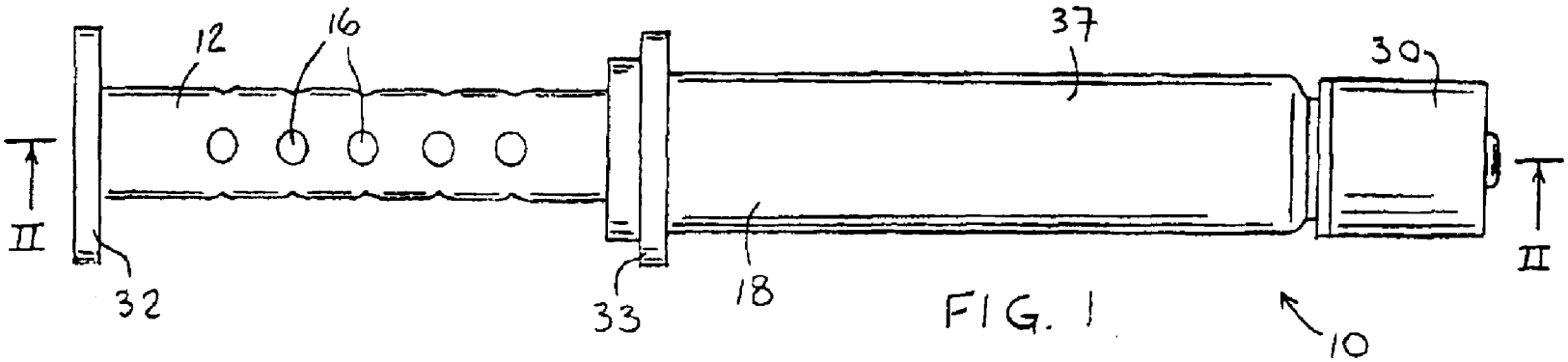

Reference is now made to FIGS. 1 and 2, which illustrate an explosion simulator 10, constructed and operative in accordance with a preferred embodiment of the present invention.

Explosion simulator 10 may include a chamber 12 at least partially filled with a pyrotechnic material 14. The pyrotechnic material 14 may comprise, without limitation, flash powder or smoke powder, for generating explosion, flash, smoke or bang cues. For example, certain inorganic oxide powders may be used as smoke powders since they are substantially environmentally safe, nonflammable, nontoxic and relatively inexpensive. In addition, different inorganic oxides may produce different colored smoke clouds. For example, titanium oxide and talc may produce white smoke clouds. Iron oxide may be used in a variety of colors (e.g., red, orange, yellow, brown or black). As another example, pyrotechnic material 14 may comprise aluminum powder or fireworks powder.

Chamber 12 may be formed with a generally cylindrical shape with a plurality of holes 16 formed along a longitudinal length thereof. The holes 16 may be arranged for fluid (e.g., gas, fumes or liquid) products of an explosion of pyrotechnic material 14 to pass therethrough. There may be at least two sets of holes 16 spaced radially from one another about a perimeter of chamber 12. In the illustrated embodiment, there are four sets of holes 16 spaced generally equidistantly from one another about the perimeter of chamber 12.

A handle 18 is preferably provided extending away from chamber 12. In the illustrated embodiment, handle 18 may be coaxial with chamber 12. A delaying detonator 20 may be disposed in a region near the junction between handle 18 and chamber 12. Detonator 20 may include any suitable ignitable material 22, which when ignited, detonates the pyrotechnic material 14 in chamber 12. The ignitable material 22 may be disposed relative to the pyrotechnic material 14 such that the pyrotechnic material 14 may be detonated only after a period of time from the actuation of the detonator 20. This may be accomplished, for example, by placing one end of the ignitable material 22 in juxtaposition with the pyrotechnic material 14 and igniting the opposite end of the ignitable material 22. The ignitable material 22 may detonate the pyrotechnic material 14 only after passing through an aperture 23 formed between chamber 12 and handle 18. Alternatively, ignitable material 22 may include a delaying compound that retards the ignition of the ignitable material 22. As another alternative, detonator 20 may be electric, and comprise delay circuitry.

In the illustrated embodiment, for example, detonator 20 may comprise a friction cap 24 adapted to ignite upon a sufficient rubbing action against an inner wall 26 formed in handle 18. Friction cap 24 may be attached to a pull-string 28 disposed through handle 18, which may be attached to a screw-off or pull-off cap 30.

A collar 32 may protrude outwardly from chamber 12 and another collar 33 may protrude from handle 18. Collar 32 or 33 may permit placing explosion simulator on the ground without any of the holes 16 being blocked by the ground. Collar 32 or 33 may have any arbitrary shape and may include a flat face to allow placement on the ground without rolling.

By removing cap 30 from handle 18 and pulling pull-string 28 generally in the direction of an arrow 34, friction cap 24 rubs against inner wall 26 and ignites ignitable material 22 of detonator 20. After a certain delay, ignitable material 22 detonates the pyrotechnic material 14, whereupon explosive fluid products may be expelled through holes 16. One of the advantages of the illustrated arrangement of holes 16 is that fluid expelled through the holes 16 may not cause the simulator 10 to jump up from the ground. Instead the explosive fluid products may be expelled through holes 16 in uniform directions with respect to chamber 12.

The handle 18 preferably comprises a hand-grip portion 37 positioned separately from the pyrotechnic material 14. Accordingly, the explosion simulator 10 may be easily thrown like a stick, and may be used in a wide variety of military and civilian applications. The simulator 10 may not cause damage to the hand of the user even if it accidentally explodes while being held in the hand.

Other variations of the explosion simulator are possible within the scope of the invention. As one example, reference is now made to FIGS. 3 and 4, which illustrate an explosion simulator 40, constructed and operative in accordance with another preferred embodiment of the present invention. Explosion simulator 40 may be constructed similarly to explosion simulator 10 with like elements being designated by like numerals. In explosion simulator 40, a delaying detonator 42 comprising a friction cap 44, instead of being disposed at the junction between handle 18 and chamber 12, may be disposed at one end of chamber 12. Detonator 42 may be actuated by simply rubbing friction cap 44 to ignite the ignitable material (not shown) disposed in detonator 42.

Figure 3:
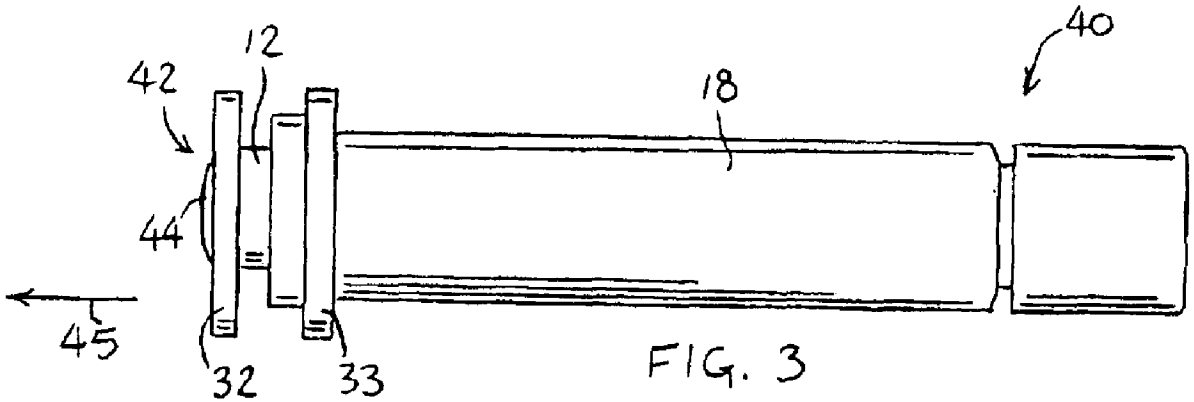
FIGS. 3 and 4 are simplified pictorial illustrations of an explosion simulator, constructed and operative in accordance with another preferred embodiment of the present invention, illustrating the explosion simulator in respective contracted and extended orientations.
Figure 4:
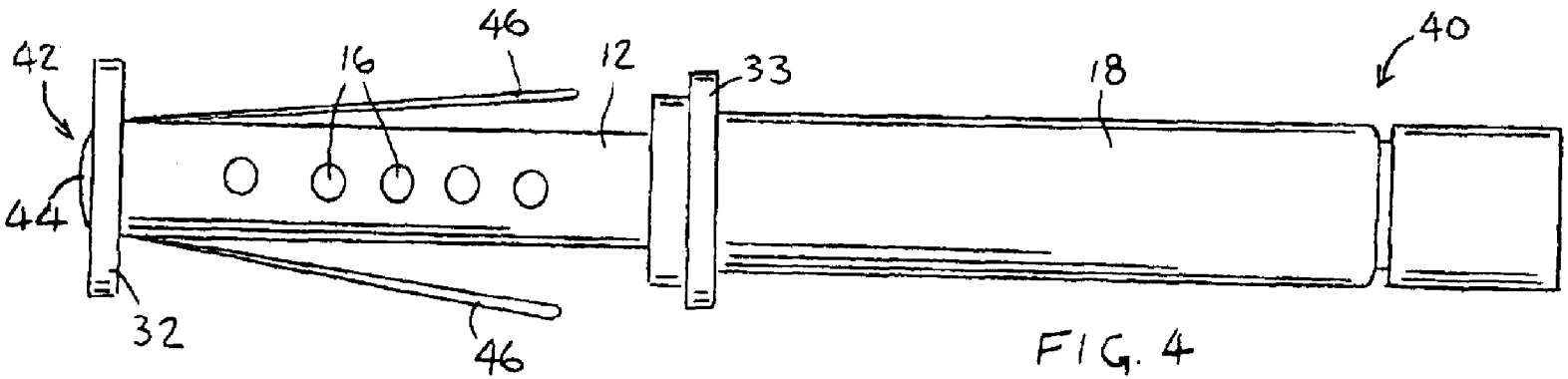

The chamber 12 of explosion simulator 40 may be telescopically extensible from handle 18. FIG. 3 illustrates a contracted orientation of the chamber 12, wherein chamber 12 is retracted inside handle 18. FIG. 4 illustrates an extended orientation of the chamber 12, wherein chamber 12 is pulled out of handle 18 generally in the direction of an arrow 45.

The chamber 12 may include anti-gripping elements 46. For example, anti-gripping elements 46 may include resilient, elongate tongues adapted to extend outwards from chamber 12 when chamber 12 is in the extended orientation. The tongues may be urged back towards chamber 12 when pushing chamber 12 back into handle 18. The anti-gripping elements 46 may interfere with manually gripping chamber 12, and thus provide an added degree of safety against accidental injury.

It will be appreciated by person skilled in the art that the present invention is not limited by what has been particularly shown and described herein above. Rather the scope of the present invention is defined only by the claims that follow:

What is claimed is:

1. An explosion simulator comprising:

a chamber at least partially filled with a pyrotechnic material, said chamber being formed with a plurality of holes arranged for fluid products of an explosion of said pyrotechnic material to pass therethrough;

a delaying detonator adapted to detonate said pyrotechnic material, said detonator being adapted to delay onset of said explosion of said pyrotechnic material a period of time after actuation of said detonator; and a handle extending from said chamber, said handle comprising a hand-grip portion positioned separately from said pyrotechnic material.

2. The explosion simulator according to claim 1, wherein said holes are formed along a longitudinal length of said chamber.

3. The explosion simulator according to claim 1, wherein said holes include at least two sets of holes spaced about a perimeter of said chamber.

4. The explosion simulator according to claim 1, wherein said holes include at least four sets of holes spaced about a perimeter of said chamber.

5. The explosion simulator according to claim 1, wherein said sets of holes are spaced generally equidistantly about a perimeter of said chamber.

6. The explosion simulator according to claim 1, wherein said detonator comprises a friction cap adapted to ignite upon a sufficient rubbing action.

7. The explosion simulator according to claim 6 wherein said friction cap is attached to a pull-string.

8. The explosion simulator according to claim 1, wherein said detonator comprises a friction cap adapted to ignite upon a sufficient rubbing action, said friction cap being attached to a pull-string disposed through said handle.

9. The explosion simulator according to claim 1, further comprising a collar that protrudes outwardly from at least one of said chamber and said handle.

10. The explosion simulator according to claim 1, wherein said explosion simulator is stick-shaped and throwable.

11. The explosion simulator according to claim 1, wherein said chamber is telescopically extensible from said handle.

* * * * *